US012697553B2

(12) United States Patent
Kelley et al.

(10) Patent No.: US 12,697,553 B2
(45) Date of Patent: Aug. 4, 2026

(54) PROPULSION FOR AMUSEMENT PARK RIDE

(71) Applicant: UNIVERSAL CITY STUDIOS LLC, Universal City, CA (US)

(72) Inventors: Sarah Anne Kelley, Orlando, FL (US); Eric Allan Vance, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 632 days.

(21) Appl. No.: 18/113,945

(22) Filed: Feb. 24, 2023

(65) Prior Publication Data

US 2024/0286051 A1 Aug. 29, 2024

(51) Int. Cl.
*A63G 31/00* (2006.01)
*A63G 3/00* (2006.01)

(52) U.S. Cl.
CPC ..... *A63G 31/007* (2013.01); *A63G 3/00* (2013.01)

(58) Field of Classification Search
None
See application file for complete search history.

(56) References Cited

U.S. PATENT DOCUMENTS

| | | | | |
|---|---|---|---|---|
| 3,848,537 | A * | 11/1974 | Rodot | A63G 3/00 104/154 |
| 3,930,450 | A * | 1/1976 | Symons | A63G 3/00 104/73 |
| 6,971,317 | B2 | 12/2005 | Mckoy | |
| 8,091,483 | B1 | 1/2012 | Sumner | |
| 8,453,579 | B2 | 6/2013 | Nemeth | |
| 2006/0130698 | A1 | 6/2006 | Burger et al. | |
| 2013/0025491 | A1 | 1/2013 | Crawford et al. | |
| 2020/0155953 | A1 * | 5/2020 | Vance | A63G 21/18 |

FOREIGN PATENT DOCUMENTS

GB 1600937 A 10/1981

OTHER PUBLICATIONS

International Search Report and Written Opinion—PCT/US2023/031085—ISA/EPO—Dec. 12, 2023.

* cited by examiner

*Primary Examiner* — Omar S Parra
(74) *Attorney, Agent, or Firm* — Fletcher Yoder, P.C.

(57) ABSTRACT

Aspects of the present disclosure relate to methods, apparatuses, and systems for implementing a vehicle system for amusement parks. A vehicle system can have one or more vehicles for carrying passengers. Each vehicle can be propelled via a propulsion assembly that is propelled by a flow of fluid. In some aspects, the propulsion assembly can provide one or more adjustable surfaces that extend into the flow of fluid in a trough.

18 Claims, 17 Drawing Sheets

PROPULSION FOR AMUSEMENT PARK RIDE

TECHNICAL FIELD

The present disclosure generally relates to amusement park rides, and more particularly, fluid propulsion techniques for amusement park rides.

INTRODUCTION

An amusement park can provide various kinds of rides that can carry one or more passengers to move along a predefined track, path, or channel. A typical ride can be guided and propelled by an assembly under the ride that is attached to equipment (e.g., wheels, chains, tracks, etc.) moving under the ride. However, the equipment can present a hazard or pinch points to the passenger of the ride, in particular, when the passenger embarks and disembarks the ride. Accordingly, aspects of the present disclosure are directed to fluid propulsion techniques that can eliminate or reduce many of the hazards associated with propulsion of amusement park rides.

BRIEF SUMMARY OF SOME EXAMPLES

The following presents a summary of one or more aspects of the present disclosure, in order to provide a basic understanding of such aspects. This summary is not an extensive overview of all contemplated features of the disclosure and is intended neither to identify key or critical elements of all aspects of the disclosure nor to delineate the scope of any or all aspects of the disclosure. Its sole purpose is to present some concepts of one or more aspects of the disclosure in a simplified form as a prelude to the more detailed description that is presented later.

Aspects of the present disclosure relate to methods, apparatuses, and systems for implementing a vehicle system for amusement parks. A vehicle system can have one or more vehicles (e.g., water rides) for carrying passengers. Each vehicle can be propelled to move via a propulsion assembly located under the vehicle that is propelled by a fluid flow. In some aspects, the propulsion assembly can provide one or more adjustable surfaces that extend into the fluid flow flowing in a trough.

One aspect of the disclosure provides a vehicle system. The vehicle system includes a trough with a first fluid in the trough. The vehicle system further includes a vehicle including a propulsion assembly, and the propulsion assembly includes a controllable surface to engage the first fluid. The controllable surface is adjustable to control a force applied on the controllable surface by the first fluid. In one aspect, the propulsion assembly can extend downward underneath the vehicle.

One aspect of the disclosure provides a vehicle for an amusement park ride. The vehicle includes a hull for carrying a passenger in a body of a first fluid. The vehicle further includes a propulsion assembly, and the propulsion assembly includes a controllable surface to engage a flow of a second fluid flowing in a trough. In one aspect, the second fluid can flow in a trough below the body of the first fluid. The propulsion assembly is configured to adjust the controllable surface from a first configuration to a second configuration to change at least one of a speed or a direction of the vehicle in the body of the first fluid. In one aspect, the propulsion assembly can extend downward underneath the hull.

One aspect of the disclosure provides a method of operating an amusement park ride. The method includes a process of generating a flow of a first fluid in a trough extending on a floor. The method further includes a process of propelling a vehicle above the floor using the flow of the first fluid, the vehicle including a propulsion assembly. The method further includes a process of adjusting a controllable surface of the propulsion assembly to engage the flow of the first fluid to control a force applied on the controllable surface by the flow of the first fluid. In one aspect, the propulsion assembly can extend downward underneath the vehicle.

DETAILED DESCRIPTION

Figure 1:
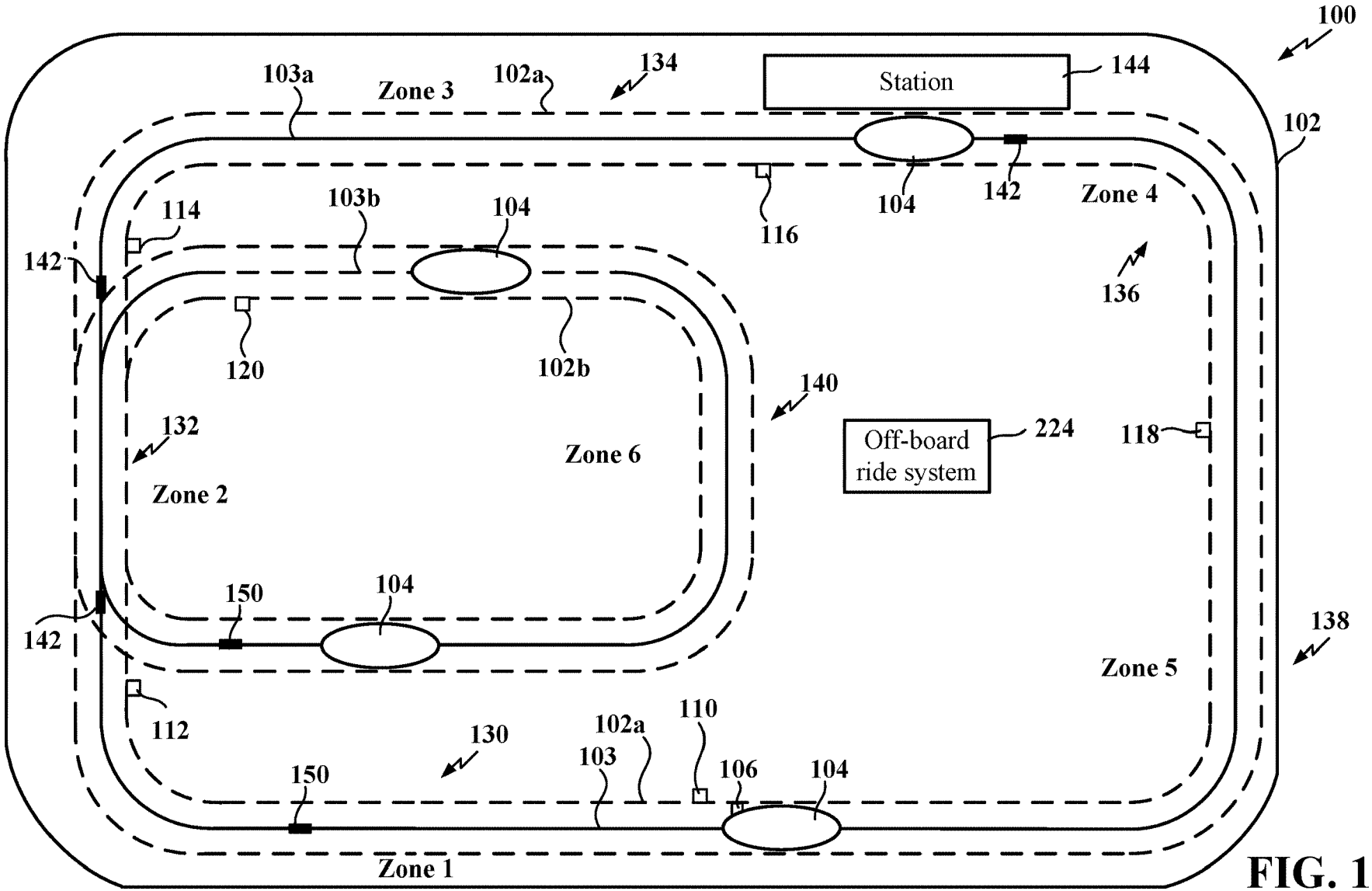
FIG. 1 is a block diagram of an exemplary ride system according to some aspects of the present disclosure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well-known structures and components are shown in block diagram form in order to avoid obscuring such concepts. While aspects and embodiments are described in this application by illustration to some examples, those skilled in the art will understand that additional implementations and use cases may come about in many different arrangements and scenarios. Innovations described herein may be implemented across many different platform types, devices, systems, shapes, sizes, and/or packaging arrangements.

The present disclosure provides apparatuses, devices, and techniques for implementing an amusement park ride. The ride can have one or more vehicles (e.g., boats, rides) for carrying passengers. Each vehicle utilizes a propulsion assembly beneath the vehicle to provide one or more adjustable surfaces that are pushed by a fluid flow to propel the vehicle toward the desired direction. In some aspects, the vehicle can float in a body of fluid (e.g., liquid (e.g., pool, water path, canal, channels, etc.), gas, etc.). In some aspects, the vehicle (e.g., a car, a bus) can ride on wheels. In some aspects, the propulsion assembly can provide one or more adjustable surfaces extending underneath the vehicle into a flow of fluid flowing in a trough or channel. An adjustable surface can be pushed by the flow of fluid to propel the vehicle forward.

In some aspects, one or more troughs (e.g., fluid channels, tubes) are provided underneath the ride along a path that the vehicle travels. In some aspects, the vehicle travels in a body of fluid above the trough when the vehicle is pushed by a flow of fluid that flows in the trough. In some aspects, the vehicle travels on a surface (e.g., a wheeled vehicle on a surface, not floating in a body of fluid) above the trough. In some aspects, the flow of fluid can flow at a substantially constant rate. By controlling the adjustable surface to catch more or less of the flow of fluid, the vehicle can change speed and/or direction. In some aspects, the flow rate of the flow of fluid can be different in different troughs or different sections of the trough.

In some aspects, the flow rate of the fluid in the trough can be the same or different than the flow rate of the body of fluid in which the vehicle travels. In one example, the flow rate of the fluid in the trough is greater than that of the body of fluid. In one example, the flow rate of the fluid in the trough is less than that of the body of fluid. In one example, the flow rate of the fluid in the trough is the same as that of the body of fluid. In one example, the fluid in the trough is not flowing or substantially still, and the body of fluid has a non-zero flow rate. In some aspects, the flow direction of the fluid in the trough can be the same or different (e.g., opposite, different angles) than that of the body of fluid. In some aspects, the body of fluid may not be a flowing body of fluid (e.g., still water or air).

In some aspects, one or more gates can be provided in the fluid or trough to create block zones for stopping or braking the vehicle. For example, the gate can back up the fluid in a trough, causing the flow of fluid to stop or slow down. The vehicle's propulsion assembly (e.g., the adjustable surface(s)) can push against the gate to stop or slow down the vehicle. In some aspects, the adjustable surface can be controlled remotely (e.g., a ride control system) and/or locally onboard the ride (e.g., by a passenger).

FIG. 1 is a top view of a vehicle system 100 in accordance with various aspects of the disclosure. As shown in FIG. 1, the vehicle system 100 may include a body of fluid 102 and one or vehicles 104 (e.g., boats, water rides) configured to float and move in the body of fluid 102. The vehicle 104 can float freely in the fluid without being mechanically coupled to boundaries of the body of fluid (e.g., sides of the body of fluid, floor of the body of fluid). In some aspects of the disclosure, a trough 103 (e.g., fluid channel or canal) can extend along a floor or lower part of the body of fluid 102, for guiding and/or moving the vehicle 104 in the body of fluid 102. The body of fluid 102 can have other sizes and shapes (e.g. a pool, a canal, a path, a channel) that can hold a body of fluid (e.g., water) in which the trough 103 can be located below the body of fluid.

In some aspects, the body of fluid 102 may include multiple sections (e.g., a first section 102*a* and a second section 102*b*). When the body of fluid 102 branches into two sections 102*a* and 102*b*, the trough 103 may also branch into two troughs 103*a* and 103*b* respectively corresponding to the first section 102*a* and second section 102*b*. In some aspects, the flow of fluid can have different flow rates in different sections. In one example, the second section 102*b* may have a higher fluid flow rate than the first section 102*a*.

The present disclosure is not limited to two sections. In other implementations, the vehicle system 100 may have more or fewer sections, and the different sections may have the same and/or different fluid flow rates in the corresponding troughs. Therefore, the vehicles 104 can be controlled to travel in the section(s) at the same or different speeds.

In some aspects, the vehicle system 100 can have other configurations. In some aspects, a body of fluid is not used in the vehicle system 100 to float the vehicles 104. In this case, the vehicles 104 can ride on wheels (or the like) on a surface. In this example, the trough 103 can be provided below the surface on which the vehicles travel on. In some aspects, the body of fluid 102 can be free airspace. In this example, the vehicle (e.g., airship) can float in free air and no physical container or channel is needed to define the body of fluid 102.

As described in detail herein, the vehicle system 100 may provide a number of location indicator devices configured to provide the vehicles with location information as the vehicles 104 travel along the body of fluid 102 (e.g., section 102*a* and section 102*b*) or the trough 103. For example, as shown in FIG. 1, the vehicle system 100 may include a first location indicator device 110, a second location indicator device 112, a third location indicator device 114, a fourth location indicator device 116, a fifth location indicator device 118, and a sixth location indicator device 120. The location indicator devices 110, 112, 114, 116, 118, and 120 may be situated on or proximate to the body of fluid 102 or the trough 103. The number of location indicator devices included in FIG. 1 represents one illustrative implementation and, therefore, it should be understood that a lesser or greater number of location indicator devices than the number of devices shown in FIG. 1 may be used in other implementations.

In some aspects of the disclosure, each location indicator device may correspond to a different portion (also referred to as a different zone) of the body of fluid 102. For example, the first location indicator device 110 may correspond to a first portion 130 (e.g., also referred to as zone 1) of the body of fluid 102, where the first portion 130 begins at the first location indicator device 110 and ends at the second location indicator device 112. As another example, the second location indicator device 112 may correspond to a second portion 132 (e.g., also referred to as zone 2) of the body of fluid 102, where the second portion 132 begins at the second location indicator device 112 and ends at the third location indicator device 114. Therefore, the location indicator devices 110, 112, 114, 116, 118, and 120 may respectively correspond to portions 130, 132, 134, 136, 138, and 140 of the body of fluid 102.

In some aspects of the disclosure, each vehicle 104 may include one or more sensors configured to receive location information from the location indicator devices of the ride system 100. For example, and as shown in FIG. 1, the vehicle 104 may include a location sensor 106 configured to receive location information from the location indicator devices 110, 112, 114, 116, 118, and 120. In some aspects, the communication of location information from a location indicator device to the location sensor 106 can go through a wired or wireless communication link (e.g., Wi-Fi, Bluetooth, near-field communication (NFC), etc.).

In some aspects, the vehicle system 100 may include one or more controllable gates 142 in the body of fluid 102 or trough 103. The gates 142 can create braking or stop zones in the body of fluid 102 (or along the trough 103) for braking and/or stopping the vehicles 104. For example, the gates 142 can be located at certain locations in the trough 103 so the gates can back up and slow down the fluid flow at specific locations along the trough and/or the gates can be located above the trough (in the body of fluid 102). When a vehicle 104 approaches a gate 142, the propulsion element of the vehicle 104 can push against the gate 142 (if activated), thus braking or stopping the vehicle. In some examples, the gate 142 can be located in front of or near a station 144 for loading and unloading passengers.

Figure 2:
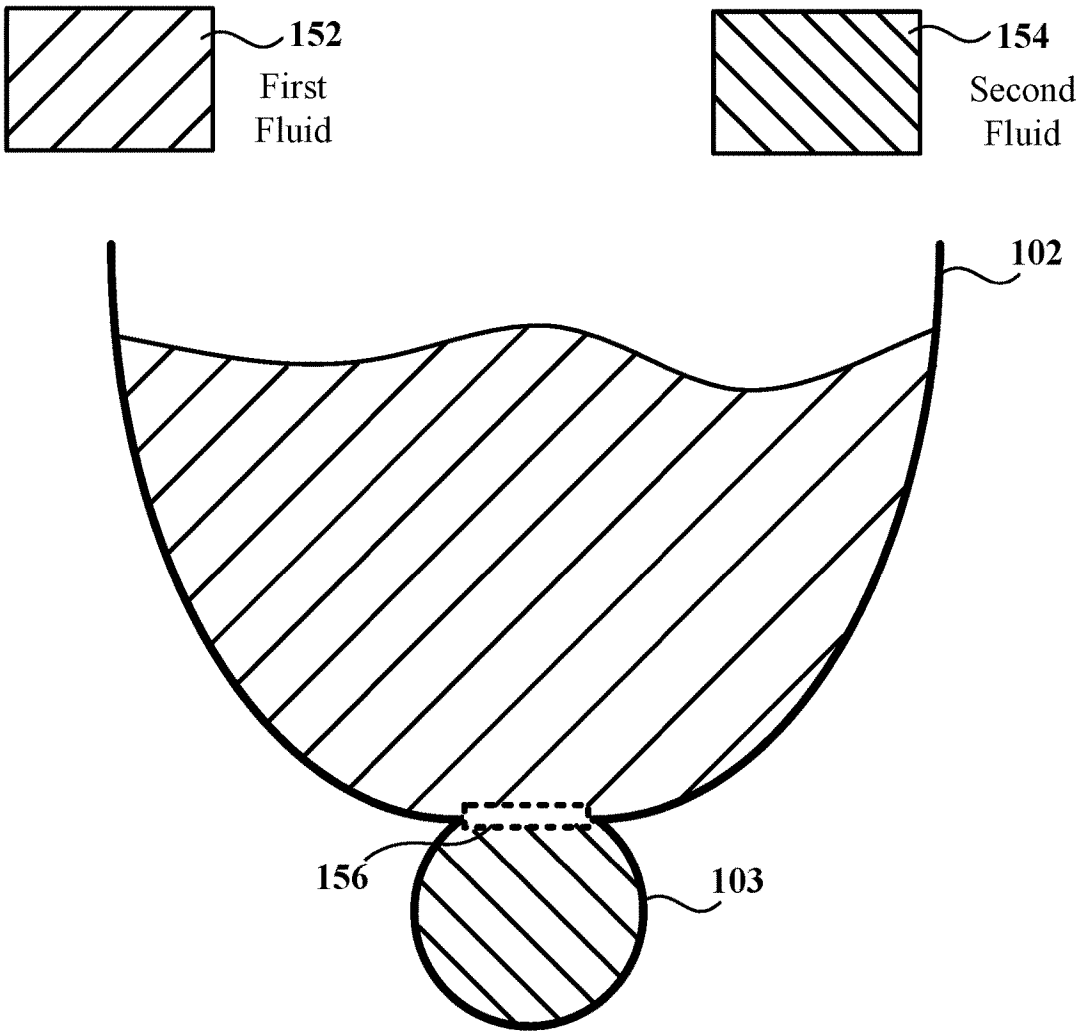
FIG. 2 is a conceptual diagram illustrating a cross-section of an exemplary body of fluid with a trough according to some aspects of the present disclosure.

FIG. 2 is a conceptual diagram illustrating a cross section of the body of fluid 102 including the trough 103 at the bottom or lower portion of the body of fluid 102 according to some aspects of the disclosure. The body of fluid 102 can be a first fluid 152 (e.g., liquid (e.g., water, aqueous solution, mixture comprising water)), and the trough 103 can be filled with a second fluid 154 (e.g., liquid (e.g., water, aqueous solution, mixture comprising water), gas (e.g., air, lighter than air gas, heavier than air gas). The first fluid 152 has a density that can facilitate the vehicle 104 to float in the body of fluid. In some aspects, the first fluid 152 may have the same or different density (e.g., higher or lower density) than the second fluid 154. In some aspects, it is contemplated that the trough 103 can be located to the side or above the body of fluid 102.

In some aspects, a seal 156 (optional) may be used to separate the body of fluid 102 (e.g., first fluid 152) from the trough 103 or the second fluid 154. For example, the seal 156 can extend along the trough 103. The seal 156 can be configured to allow a propulsion element and/or connection between the propulsion element and the vehicle 104 under the vehicle 104 to pass through so as to access the second fluid 154 in the trough 103. The propulsion element (e.g., moveable propulsion elements 204 and 206) will be described in more detail below in reference to other figures. In one example, the seal 156 may include one or more brushes. In another example, the seal 156 may include one or more flaps made of metal, rubber, or any other suitable material. The seal 156 will be described in more detail below in relation to FIG. 15.

Figure 3:
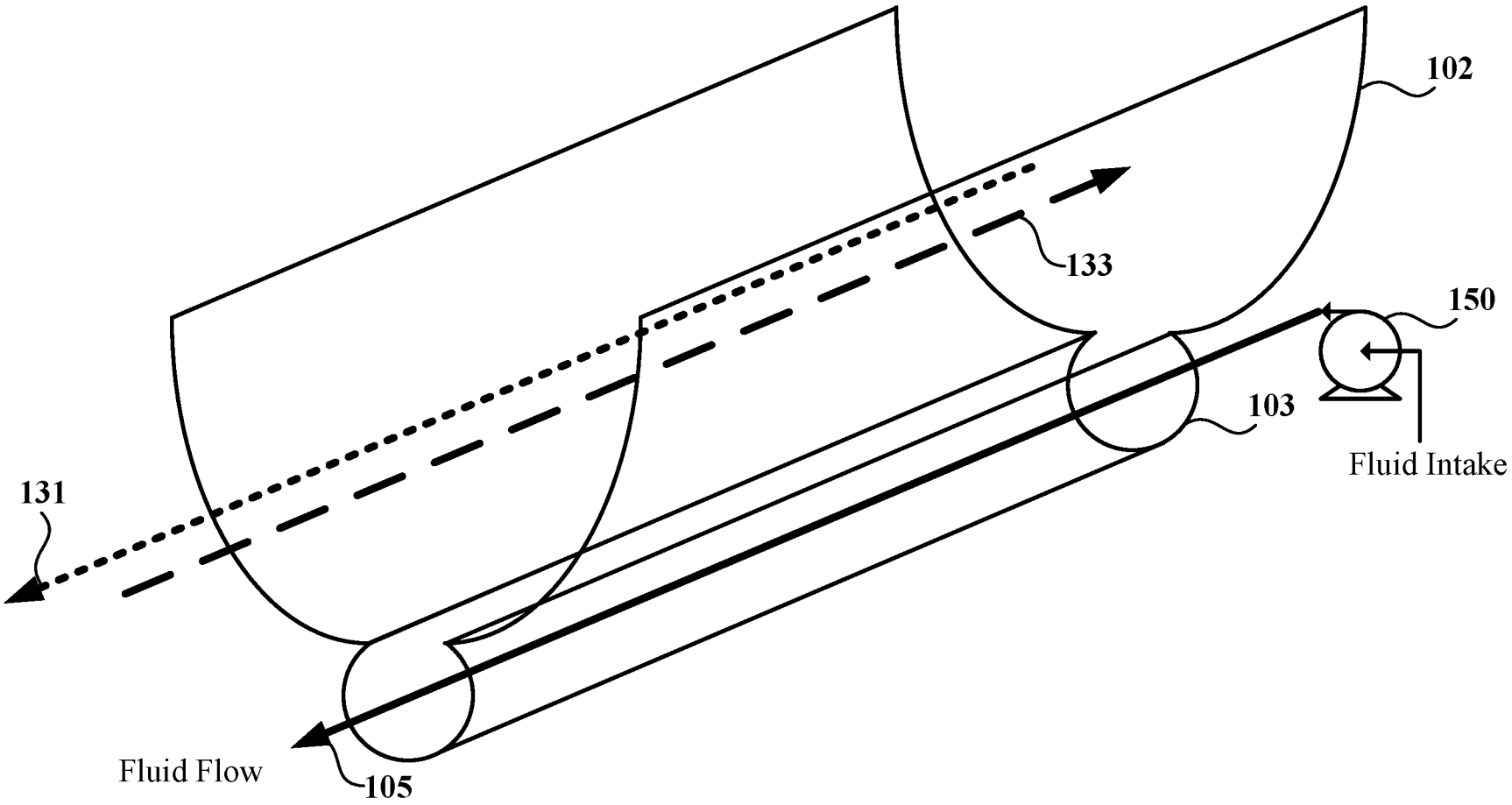
FIG. 3 is a conceptual diagram illustrating a perspective view of a portion of the body of fluid of FIG. 2 with a flow of fluid flowing in the trough according to some aspects of the present disclosure.

FIG. 3 is a conceptual perspective view of a section of the body of fluid 102 with a fluid flow 105 flowing in the trough 103. In some aspects, the fluid flow 105 can flow in the trough 103 at a predetermined flow rate (e.g., a constant flow rate or non-zero flow rate) or a flow rate relative (e.g., faster or slower) to the body of fluid 102. In some embodiments, the fluid flow 105 may have different flow rates in different sections of the body of fluid 102. In one example, the fluid flow rate can be higher in the portion 140 (zone 6) than other portions 130, 132, 134, 136, and 138 of the body of fluid 102. In one example, the fluid flow rate can be 3 meters per second (3 m/s) or less. In one example, the fluid can be air or water. In some aspects, the vehicle system 100 may use one or more fluid pumps or fluid compressors (e.g., exemplary fluid pumps 150 shown in FIGS. 1 and 3) or the like to generate the desired flow rate or pressure of the flow of fluid flowing in the trough 103. In some aspects, the one or more fluid pumps or fluid compressors can generate a flow rate 131 or 133 in the body of fluid 102 relative to the fluid flow 105 in the trough 103. In some examples, the flow rate of the fluid in the trough can be substantially zero (e.g., zero flow rate or non-moving). In some examples, the body of fluid 102 can have a non-zero flow rate.

In FIGS. 2 and 3, the dimensions and shapes of the body of fluid 102, trough 103, rides 104, pump 150, and other features are illustrative only, and they may have other designs and dimensions in other implementations. In some examples, the body of fluid 102 and/or the trough 103 may have flat sides (e.g., rectangular shapes) instead of the rounded shapes shown in FIGS. 2 and 3. In one example, the body of fluid 102 may be air and has no defined boundary.

Figure 4:
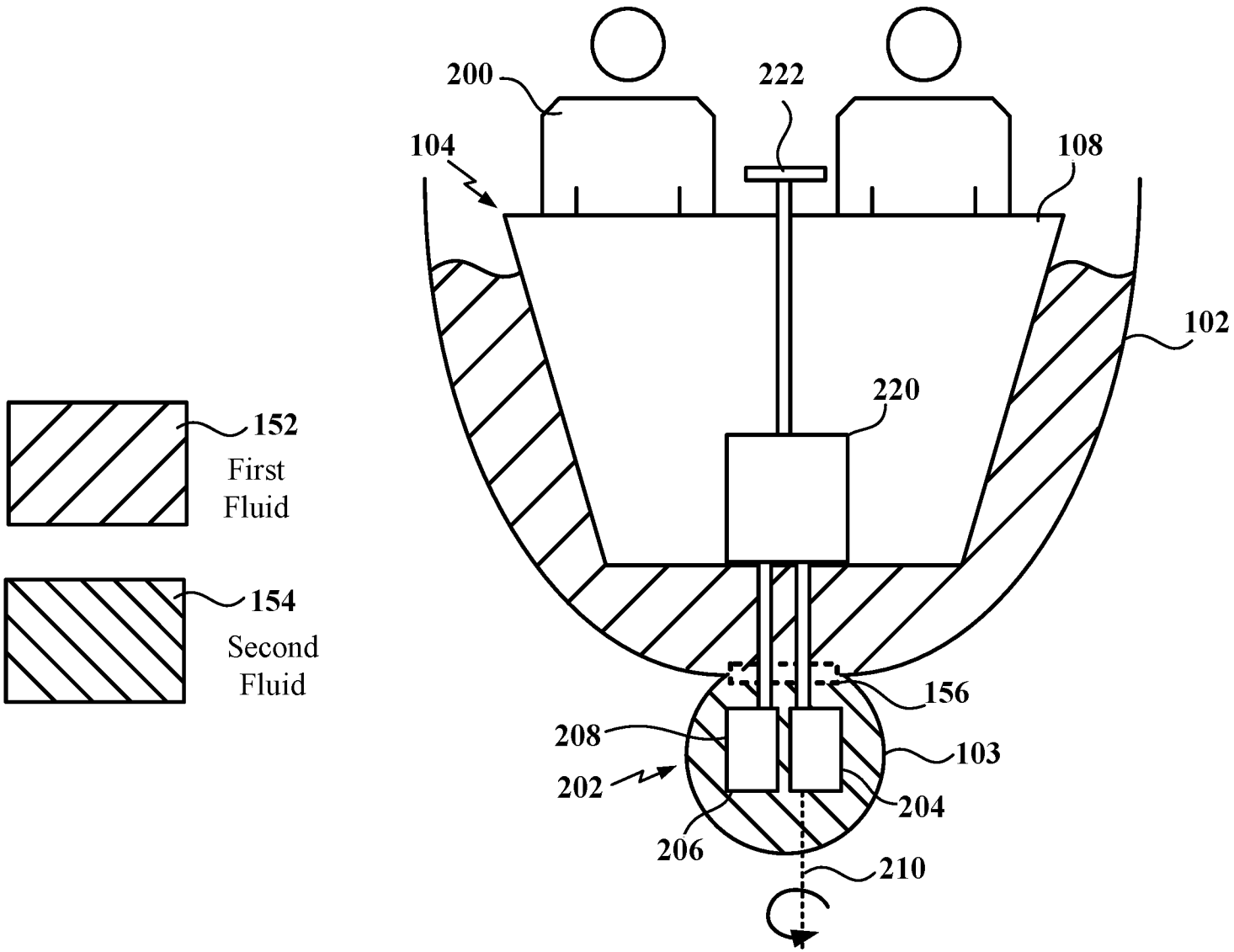
FIG. 4 is a conceptual diagram illustrating a front view of an exemplary vehicle with a propulsion assembly according to some aspects of the present disclosure.

FIG. 4 is a conceptual diagram illustrating a front view of an exemplary vehicle 104 with a propulsion assembly according to some aspects of the disclosure. The vehicle 104 may have a floatable hull 108 that can carry one or more passengers 200 for an amusement ride in the body of fluid 102 (e.g., a first fluid 152). In some aspects, the vehicle 104 can be propelled forward by the flow of a second fluid 154 (e.g., flow of fluid 105 FIG. 3) in the trough 103 using a propulsion assembly 202 located below the vehicle 104. In some aspects, the propulsion assembly 202 provides one or more adjustable or moveable propulsion elements (e.g., first propulsion element 204 and second propulsion element 206) that can extend into the trough 103. In some aspects, each moveable propulsion element is at least capable of rotation or translation (e.g., moving up/down vertically) adjustment. When the propulsion element catches the flow of fluid flowing in the trough 103, the flow of fluid 105 can apply a force (e.g., pushing force) on the propulsion element to propel the ride 104 along the body of fluid 102. Each propulsion element can provide a controllable surface (e.g., surface 208) to adjust the force exerted on the propulsion element by the flow of fluid. In some aspects, each propulsion element can be adjusted (e.g., rotated, pivoted, and/or moved up/down) to change the angle of the controllable surface relative to the direction of the flow of fluid. For example, the propulsion element can rotate around a vertical axis 210. In some aspects, the propulsion element may be implemented as a shutter that can adjust (e.g., increase or decrease) the area of the controllable surface.

In some aspects, the vehicle 104 may have a control unit 220 onboard that is coupled to the propulsion assembly 202 to control the position and movement of the propulsion elements 204 and 206. In some aspects, the control unit 220 may provide a steering control 222 coupled directly or indirectly to the propulsion elements. The steering control 222 may enable the passenger 200 to control the propulsion elements. In one aspect, the control unit 220 may receive control information remotely (e.g., using wired communication or wireless communication) from an off-board ride system 224 (see FIG. 1) that can control one or more vehicles 104 operating in the body of fluid 102.

In some embodiments, it is contemplated that a trough with a flow of fluid (e.g., liquid (e.g., water, aqueous solution, mixture comprising water), gas (e.g., air, heavier than air gas, lighter than air gas) can be implemented in other locations instead of underneath the vehicle 104. In one example, the trough can be located on the left side or right side of the vehicle 104. In one example, the trough can be located above the vehicle 104. The propulsion element(s) of the vehicle 104 can be adapted to other positions according to the location of the trough.

Figure 5:
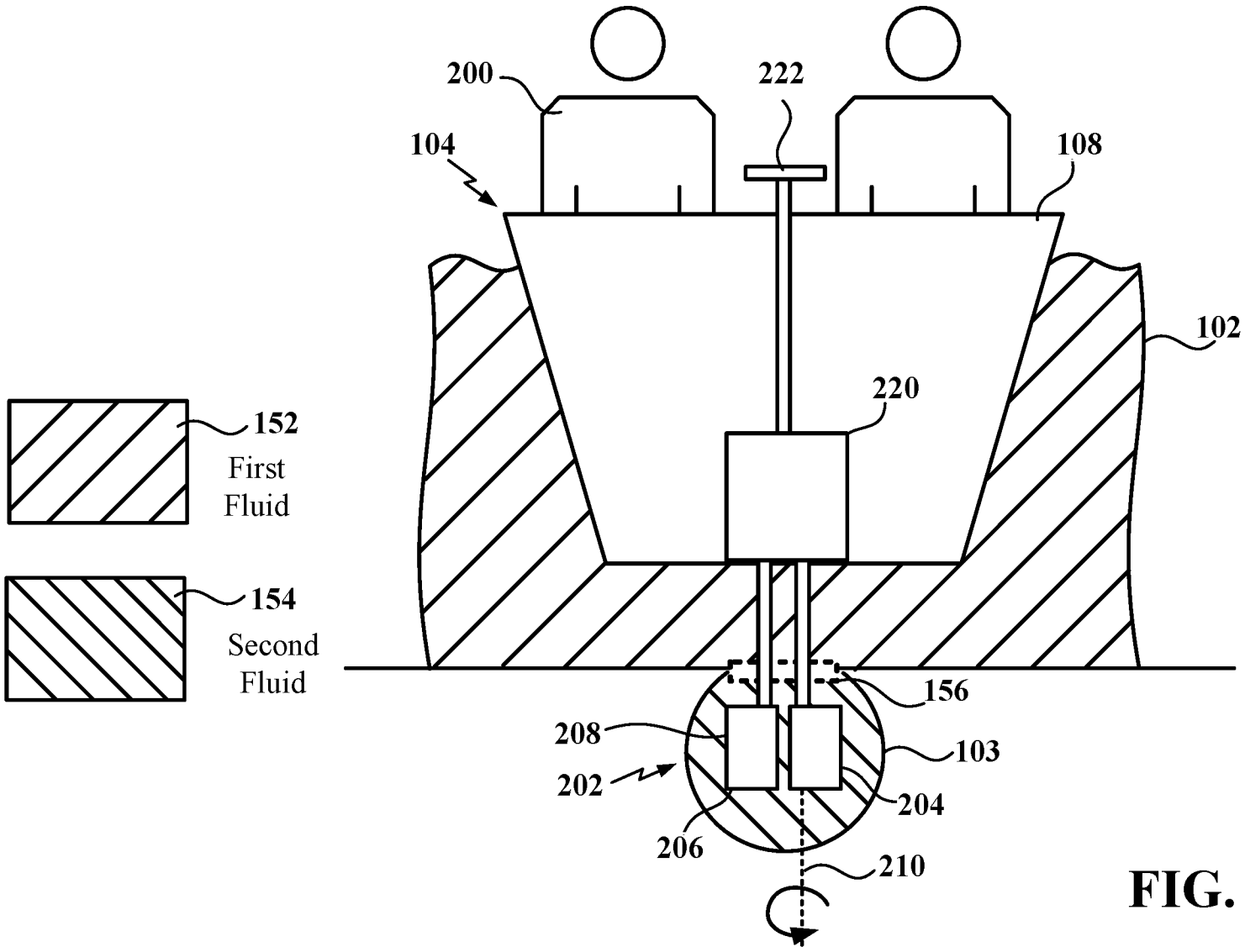
FIG. 5 is a conceptual diagram illustrating a front view of an exemplary vehicle with a propulsion assembly in a body of fluid according to some aspects of the present disclosure.

FIG. 5 is a conceptual diagram illustrating a front view of an exemplary vehicle 104 with a propulsion assembly in a body of fluid 102 having a free form. In this example, the body of fluid 102 does not have a shape (a canal, a path, a channel, etc.) that can limit or guide the forward movement of the vehicle 104 during operation. For example, the body of fluid 102 may be a pool of fluid (e.g., water) encompassing an area in which the entire trough 103 is formed. Other aspects of FIG. 5 similar to FIG. 4 are not repeated herein for brevity.

Figure 6:
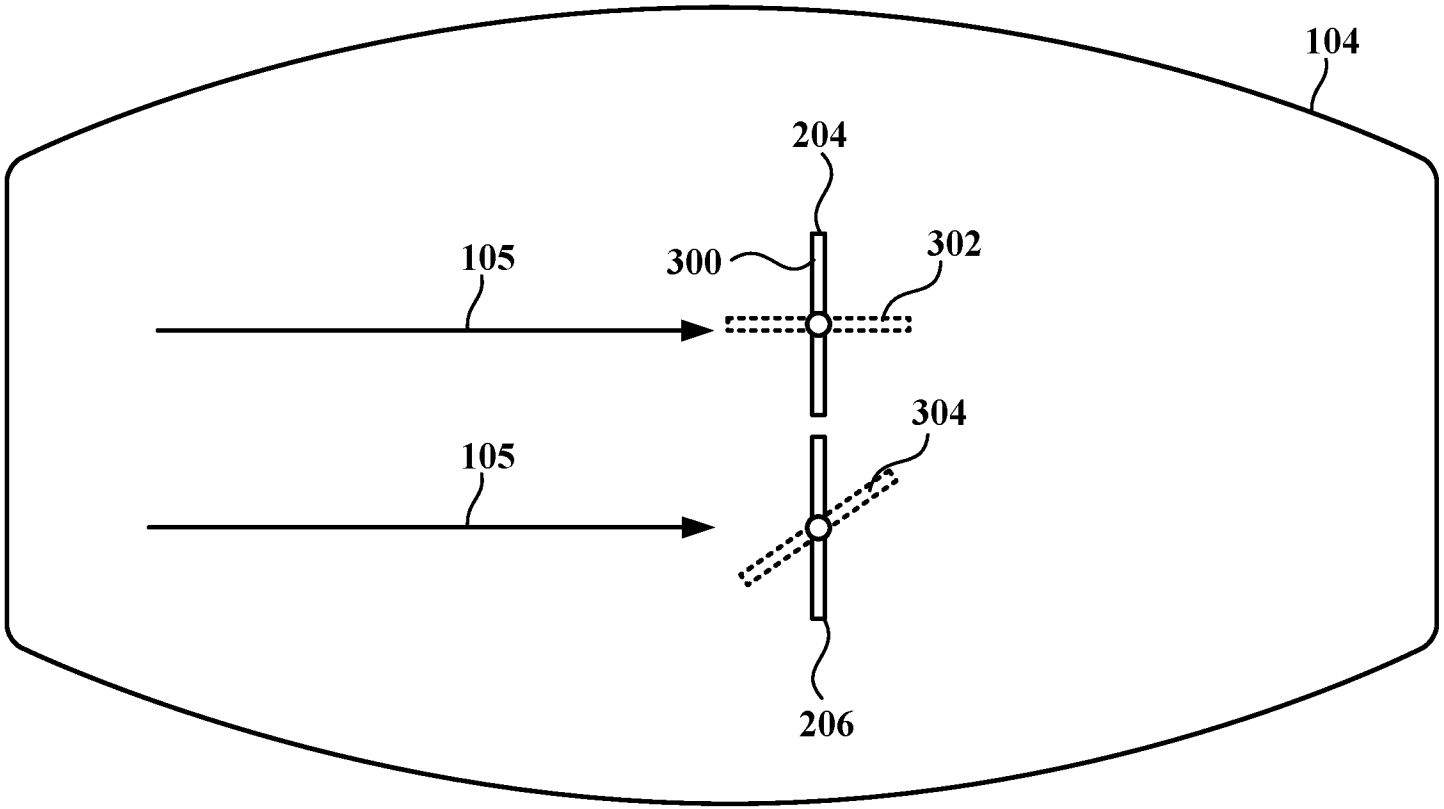
FIG. 6 is a conceptual diagram illustrating a bottom view of an exemplary vehicle equipped with propulsion elements according to some aspects of the present disclosure.

FIG. 6 is a conceptual diagram illustrating a bottom view of the vehicle 104 showing two propulsion elements 204 and 206 according to some aspects of the disclosure. In some aspects, at least the position or orientation of the propulsion elements 204 and 206 can be adjusted independently. For example, when a propulsion element is set to a first position such that a surface (e.g., surface 300) of the propulsion element is about perpendicular to the direction of the flow of fluid 105, the propulsion element can receive maximum force from the flow of fluid. When the propulsion element is set to a second position such that the surface (e.g., surface 300) of the propulsion element is about parallel to the direction of the flow of fluid 105, the propulsion element can receive minimum force from the fluid flow 105. Therefore, controlling at least the position or orientation of the propulsion element can control the amount of force received by the propulsion element from the fluid flow. In general, the larger the effective surface area of the propulsion element that faces the flow of fluid, the larger the force that the propulsion element can receive from the flow of fluid.

Figure 7:
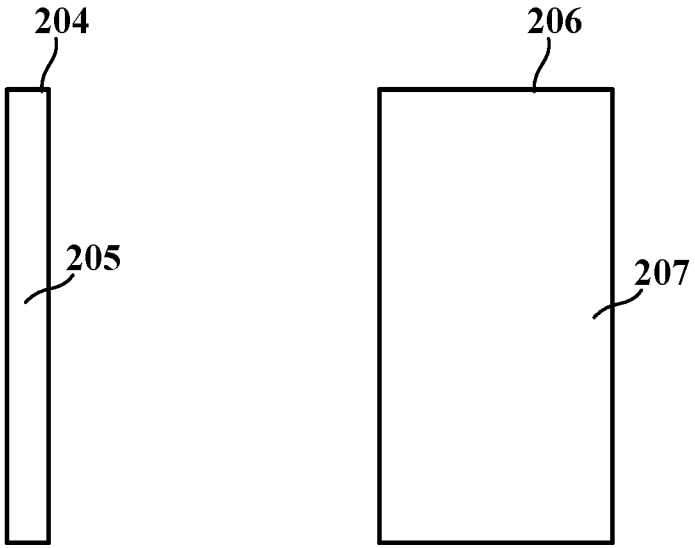
FIG. 7 is a conceptual diagram illustrating respective effective surface areas of exemplary propulsion elements according to some aspects of the present disclosure.

In some aspects, the propulsion elements 204 and 206 can provide steering control of the vehicle 104. When the propulsion elements 204 and 206 are set to different angles/positions relative to the direction of the flow of fluid, the flow of fluid applies a different amount of force on the propulsion element 204/206. For example, as shown in FIG. 6, the first propulsion element 204 can be set to a first position 302, and the second propulsion element 206 can be set to a second position 304. In this case, the second propulsion element 206 can catch more fluid of the flow of fluid than the first propulsion element 204 because the first propulsion element 204 is positioned about parallel to the fluid flow of the flow of fluid. Therefore, the flow of fluid pushes the second propulsion element 206 with greater force and causes the ride 104 to steer toward the side of the first propulsion element 204. FIG. 7 conceptually illustrates the respective effective surface areas 205 and 207 of the first and second propulsion elements 204 and 206 facing the flow of fluid. In this case, the effective surface area 207 of the second propulsion element 206 is greater than the effective surface area 205 of the first propulsion element 204. A larger effective surface allows the propulsion element to receive a greater force from the flow of fluid, and vice versa.

Figure 8:
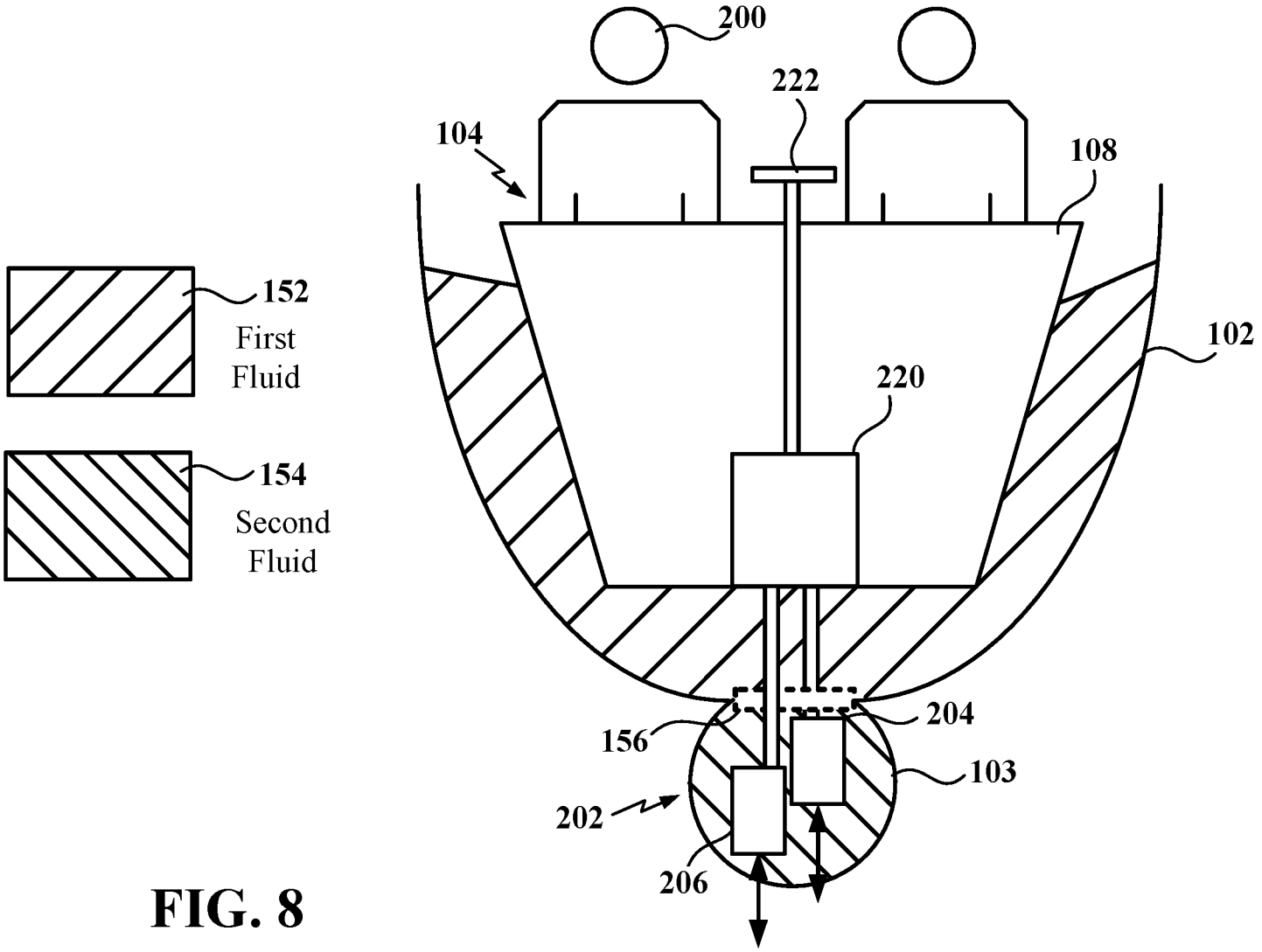
FIG. 8 is a conceptual diagram illustrating a front view of the exemplary vehicle with the propulsion assembly according to some aspects of the present disclosure.

FIG. 8 is a conceptual diagram illustrating another front view of the vehicle 104 floating in the body of fluid 102 according to some aspects of the disclosure. In this example, the propulsion elements 204 and 206 can independently move up and down. When the first propulsion element 204 moves up (e.g., raised out of the trough 103), the first propulsion element 204 catches less of the flow of fluid in the trough 103. When the second propulsion element 206 moves down (e.g., lowered into the trough 103), the second propulsion element 206 can catch more of the flow of fluid. Therefore, the flow of fluid applies more force on the lowered second propulsion element 206 relative to the force applied on the raised first propulsion element 204. The imbalance of force applied on the propulsion elements can cause the vehicle 104 to turn or steer toward the side of the first propulsion element 204. Reversing the relative positions of the propulsion elements 204 and 206 can reverse the steering direction.

Figure 9:
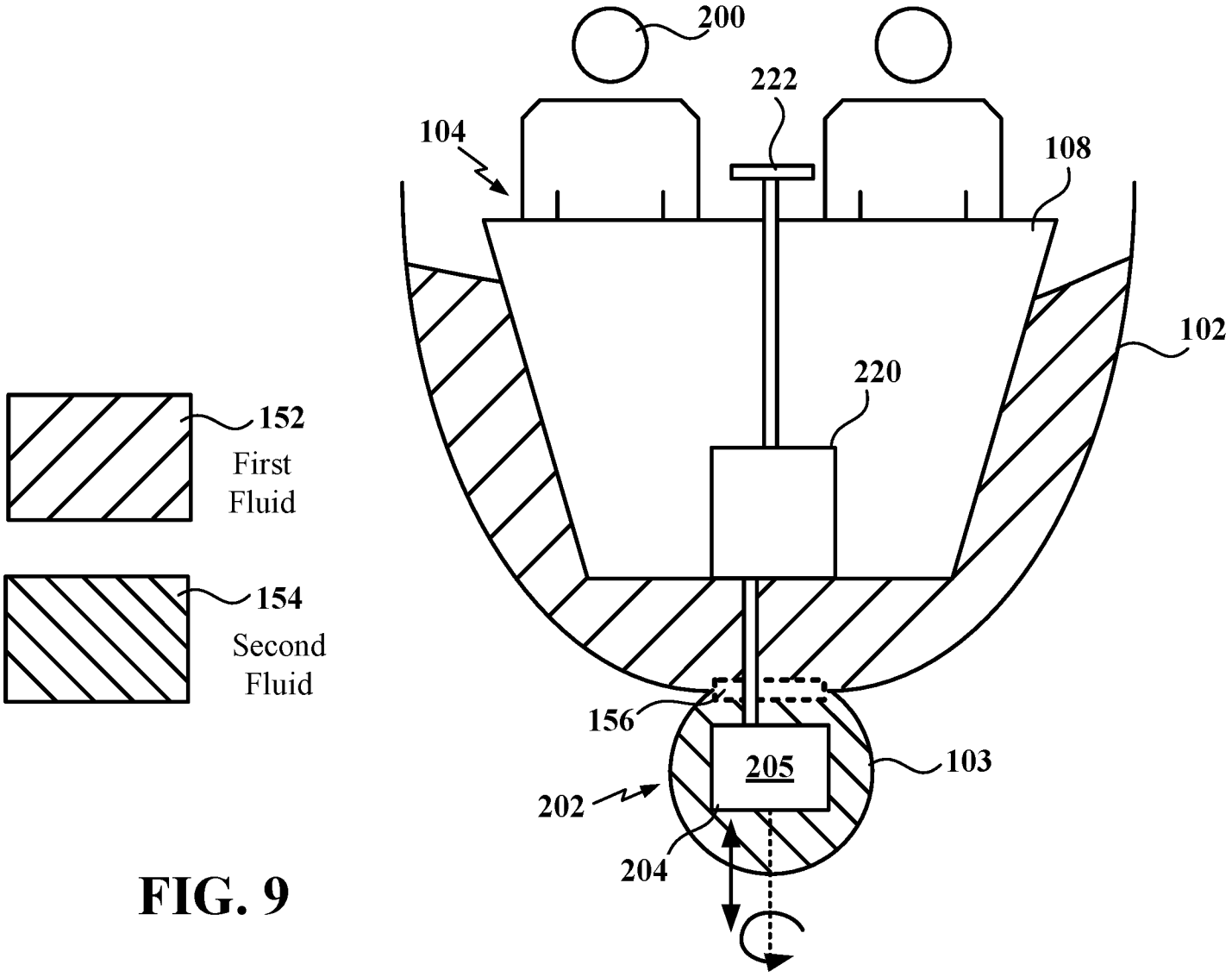
FIG. 9 is a conceptual diagram illustrating a front view of another exemplary vehicle with the propulsion assembly according to some aspects of the present disclosure.

FIG. 9 is a conceptual diagram illustrating another implementation of the vehicle 104 floating in the body of fluid 102 according to some aspects of the disclosure. In this example, the vehicle has one propulsion element 204 providing a single surface 205 that can be pushed by the flow of fluid (e.g., a flow of second fluid 154) in the trough 103. In some aspects, the propulsion element 204 can at least rotate or move up and down to control the position of the surface 205 relative to the flow of fluid in the trough 103. Therefore, controlling at least the position or orientation of the propulsion element 204 can control the amount of force received by the propulsion element from the fluid flow in the trough 103. Controlling the force (e.g., in direction and/or strength) received by the propulsion element can change the speed and/or direction of the vehicle.

Figure 10:
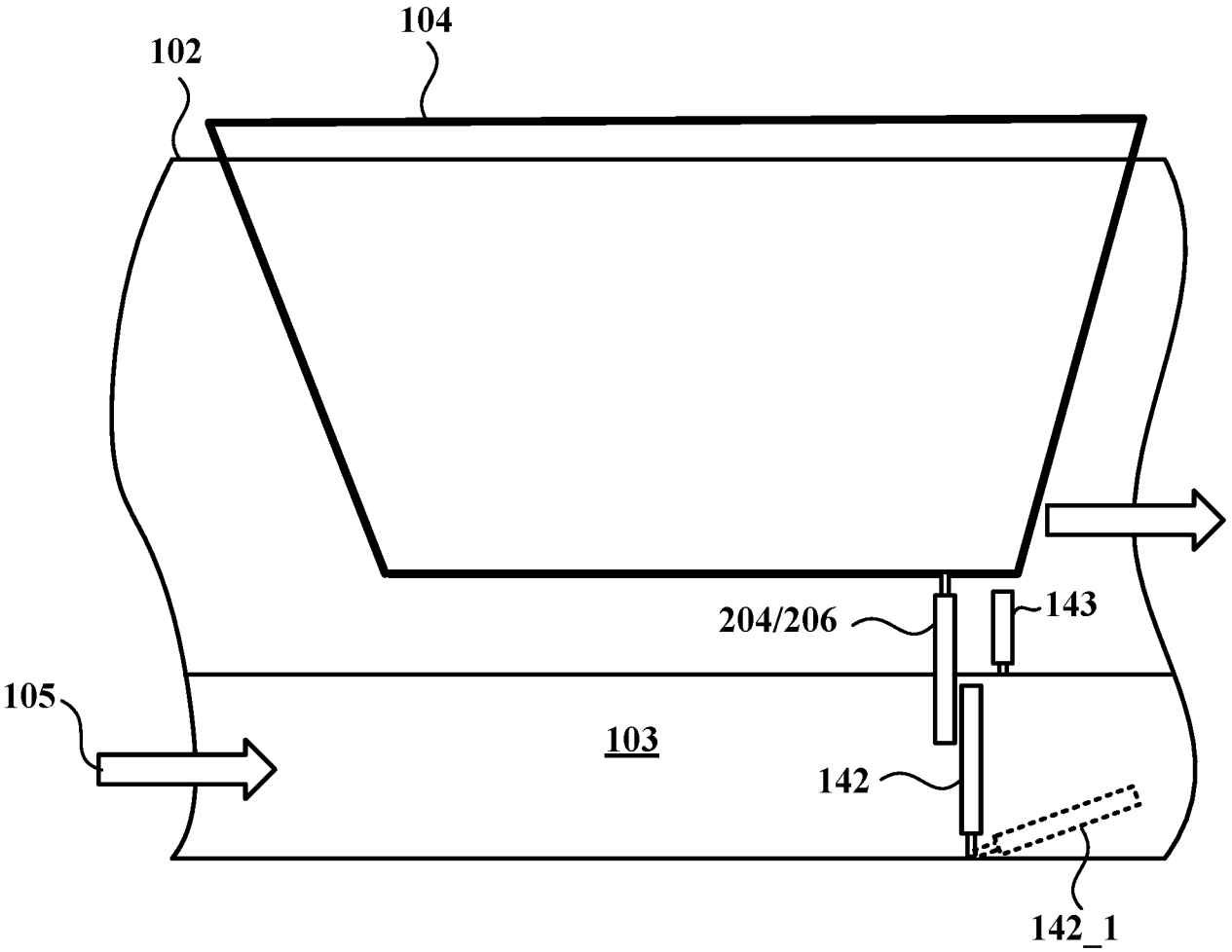
FIG. 10 is a diagram illustrating a side view of a portion of the vehicle in the body of fluid according to some aspects of the present disclosure.

FIG. 10 is a conceptual diagram illustrating a side view of a portion of the body of fluid 102 according to some aspects. As described above in relation to FIG. 1, the body of fluid 102 can have one or more gates (e.g., one gate 142 in the trough 130 and one gate 143 outside of the trough shown in FIG. 10) located at various locations of the body of fluid 102 and/or the trough 103, implementing a braking system for the vehicle 104. A position of the one or more gates 142/143 may be varied (e.g., set to an upright position or a downward position). When the vehicle 104 is propelled by the flow of fluid 105 to move toward the gate 142 or 143 that is set to the braking position (i.e., an upright position), the vehicle 104 may slow down as it approaches the gate 142/143 since the gate in the braking position causes the fluid in the trough 103 or the body of fluid to backup (i.e., have a slower flow rate) near the gate 142/143. When the propulsion elements 204/206 eventually come into contact with the gate 142/143, the vehicle 104 is stopped by the gate. In one example, when a position of the gate 142 is changed to the downward position 142_1, the flow of fluid 105 in the trough 103 can flow faster again, and the vehicle 104 can be propelled forward by the flow of fluid in the trough 103 or body of fluid 102. In other examples, the gate 142/143 can be set to various positions to vary at least the speed, volumetric flow rate, or pressure of the flow of fluid. In other implementations, the gate 142/143 can use any mechanism to switch between different positions to vary at least the speed, volumetric flow rate, or pressure of the fluid flow.

Figure 11:
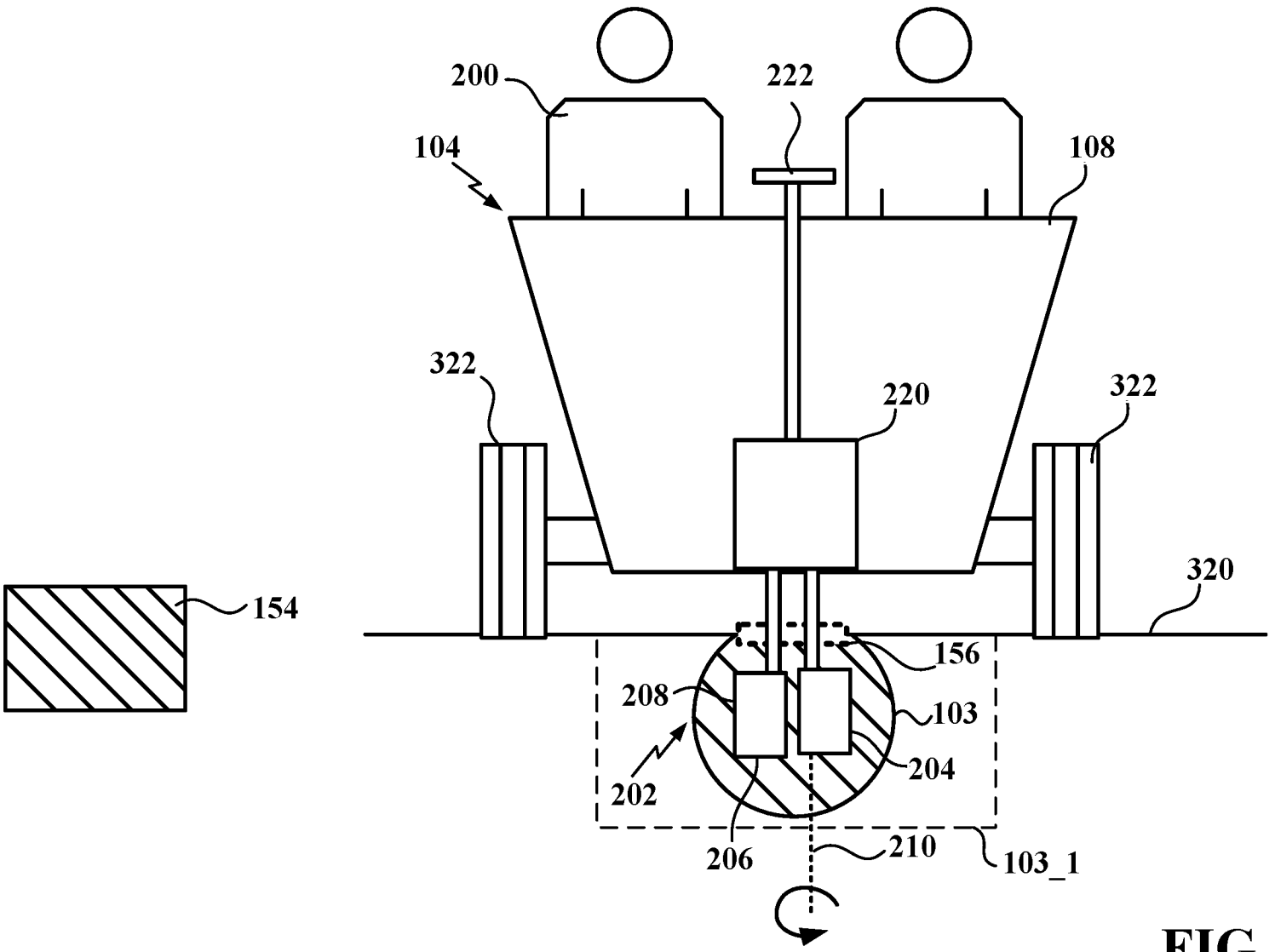
FIG. 11 is a conceptual diagram illustrating a front view of another exemplary vehicle with the propulsion assembly according to some aspects of the present disclosure.

FIG. 11 is a conceptual diagram illustrating a front view of another exemplary vehicle 104 with a propulsion assembly according to some aspects of the disclosure. The vehicle 104 may have a hull 108 that can carry one or more passengers 200 for an amusement ride. The vehicle 104 may move on a surface 320 (e.g., a floor) and have one or more wheels 322. In some aspects, the vehicle 104 can be propelled forward by the flow of a fluid 154 (e.g., water, air) in the trough 103 using a propulsion assembly 202 located below the vehicle 104. In some aspects, the propulsion assembly 202 provides one or more moveable propulsion elements (e.g., first propulsion element 204 and second propulsion element 206) that can extend into the trough 103. In some aspects, each moveable propulsion element is at least capable of rotation or translation (e.g., moving up/down vertically) adjustment. When the propulsion element catches the flow of fluid (e.g., liquid (e.g., water, aqueous solution, mixture comprising water), gas (e.g., air, heavier than air gas, lighter than air gas)) flowing in the trough 103, the flow of fluid 105 can apply a force (e.g., pushing force) on the propulsion element to propel the vehicle 104 to move on the surface 320. It is contemplated that the trough 103 can have other configurations and designs. In some embodiments, the trough 103 may have a wider width (e.g., trough 103_1) that allows the vehicle 104 to be steered or the propulsion elements to move sideways (e.g., left and right) inside the trough. Aspects of the propulsion element are similar to the embodiments described above.

Figure 12:
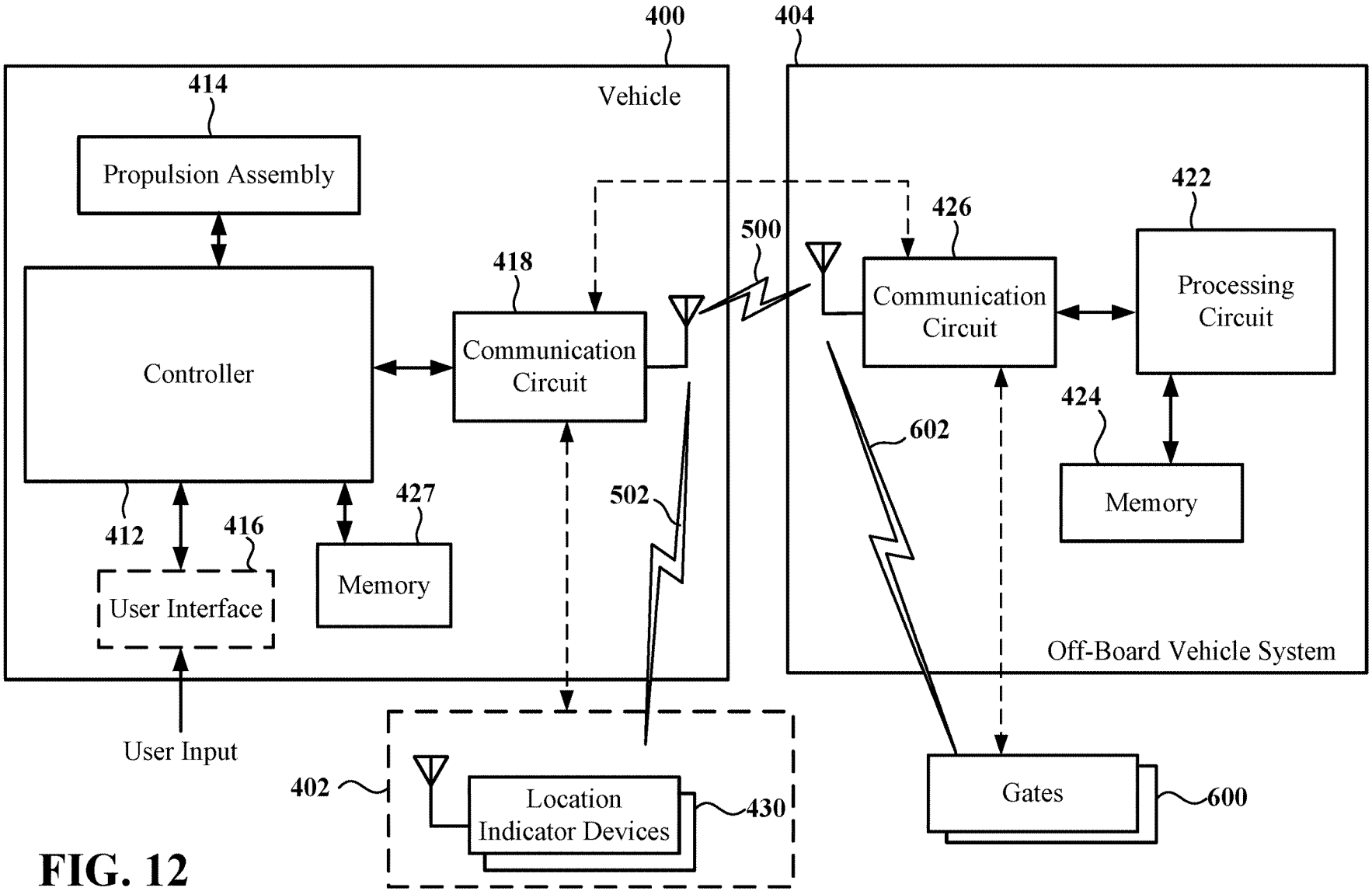
FIG. 12 is a block diagram of a vehicle system according to some aspects of the present disclosure.

FIG. 12 is a block diagram illustrating a vehicle 400, a tracking system 402, and an off-board vehicle system 404 in accordance with various aspects of the disclosure. As shown in FIG. 12, the vehicle 400 may include a controller 412, a propulsion assembly 414, and a user interface 416 (optional). In some aspects, the vehicle 400 may be used to implement the vehicle 104 described above in relation to FIGS. 1-11. In some aspects, the propulsion assembly 414 may be used to implement the propulsion assembly 202 described above. The vehicle 400 may further include a communication circuit 418 (e.g., wireless transceiver, wireless receiver, wired connection) configured to communicate ride control information 500 to and/or from the off-board vehicle system 404. In some aspects of the disclosure, the off-board ride system 404 may include a processing circuit 422, a memory device 424, and a communication circuit 426 (e.g., wireless transceiver, wireless receiver, wired connection). The off-board vehicle system 404 may be used to implement the off-board ride system 224 described above.

In some aspects, the tracking system 402 may include one or more location indicator devices 430. For example, the location indicator devices 430 may be used to implement the location indicator devices 110, 112, 114, 116, 118, and 120 described above. Each location indicator device can communicate (e.g., transmit wirelessly or through wired means) location information 502 to the vehicle 400. In some aspects, each location indicator device can transmit a unique code (e.g., a binary code) that can represent a location (e.g., zones 1, 2, 3, 4, 5, and 6 in FIG. 1) corresponding to the location indicator device. Therefore, the vehicle 400 can determine its location along the body of fluid or trough based on the location information received from the location indicator devices.

In some aspects, the location indicator devices can transmit the location information using short-range wireless communication, for example, near-field communication (NFC) NFC and Bluetooth, etc. The location indicator devices can be distributed at various locations above or in the body of fluid 102 such that the vehicle 400 will be in communication range with at least one location indicator device at a time. In some examples, a unique location code may be assigned to each location indicator device, thereby allowing the vehicle 400 to specifically identify the location indicator devices at various locations (e.g., zones). The controller 412 of the vehicle 400 may be configured to receive the location information 502 using the communication circuit 418. The controller 412 can use the received location code to determine the location of the vehicle 400 based on information stored at the memory device 427. For example, the memory device 427 may store various information (e.g., location codes) for controlling and operating the vehicle.

In some aspects, the off-board vehicle system 404 (e.g., processing circuit 422) can be configured to control multiple vehicles (e.g., vehicles 104 of FIG. 1). The off-board vehicle system 404 can receive location information 500 from all vehicles in the body of fluid 102 and control their respective speeds and/or directions along the body of fluid 102 based on the location information. For example, the off-board vehicle system 404 can control the vehicles to maintain a certain distance between the vehicles. In some aspects, the off-board vehicle system 404 can send control information 500 to the vehicles to control the moving direction and speed of any particular vehicle. In one example, the off-board vehicle system 404 can control a vehicle to slow down as it approaches a predetermined location (e.g., the station 144 of FIG. 1). In one example, the off-board vehicle system 404 can control a vehicle to steer toward a certain direction (e.g., selecting a different section 102*a* or 102*b*). The processing circuit 422 can execute a predetermined program stored in the memory device 424 to provide the control functions described above.

In response to control information 500 received from the off-board vehicle system 404, the vehicle 400 (e.g., under instruction from the controller 412) can operate the propulsion assembly 414 to change its speed and/or direction (e.g., steering). For example, the propulsion assembly 414 may include motors and/or actuators that can control propulsion elements (e.g., rotation and/or translation of propulsion elements 204 and 206) to change the speed and/or direction of the vehicle 400 according to the received control information. In some aspects, the vehicle 400 can optionally provide the user interface 416 (e.g., wheel, dial, switch, button, handle) to allow a passenger of the vehicle to have certain control of the speed and/or direction of the vehicle. In some aspects, the passenger's control of the vehicle 400 can be limited or overridden by the off-board vehicle system 404. For example, the off-board vehicle system 404 can override the user input to avoid potential collision between vehicles.

In some aspects, the off-board vehicle system 404 can control a plurality of gates 600. In some examples, the plurality of gates 600 can be used to implement the gates 142 as described above in relation to FIGS. 1-11. In some aspects, the off-board vehicle system 404 can communicate with the plurality of gates 600 using wired or wireless communication links 602 using the communication circuit 426.

Figure 13:
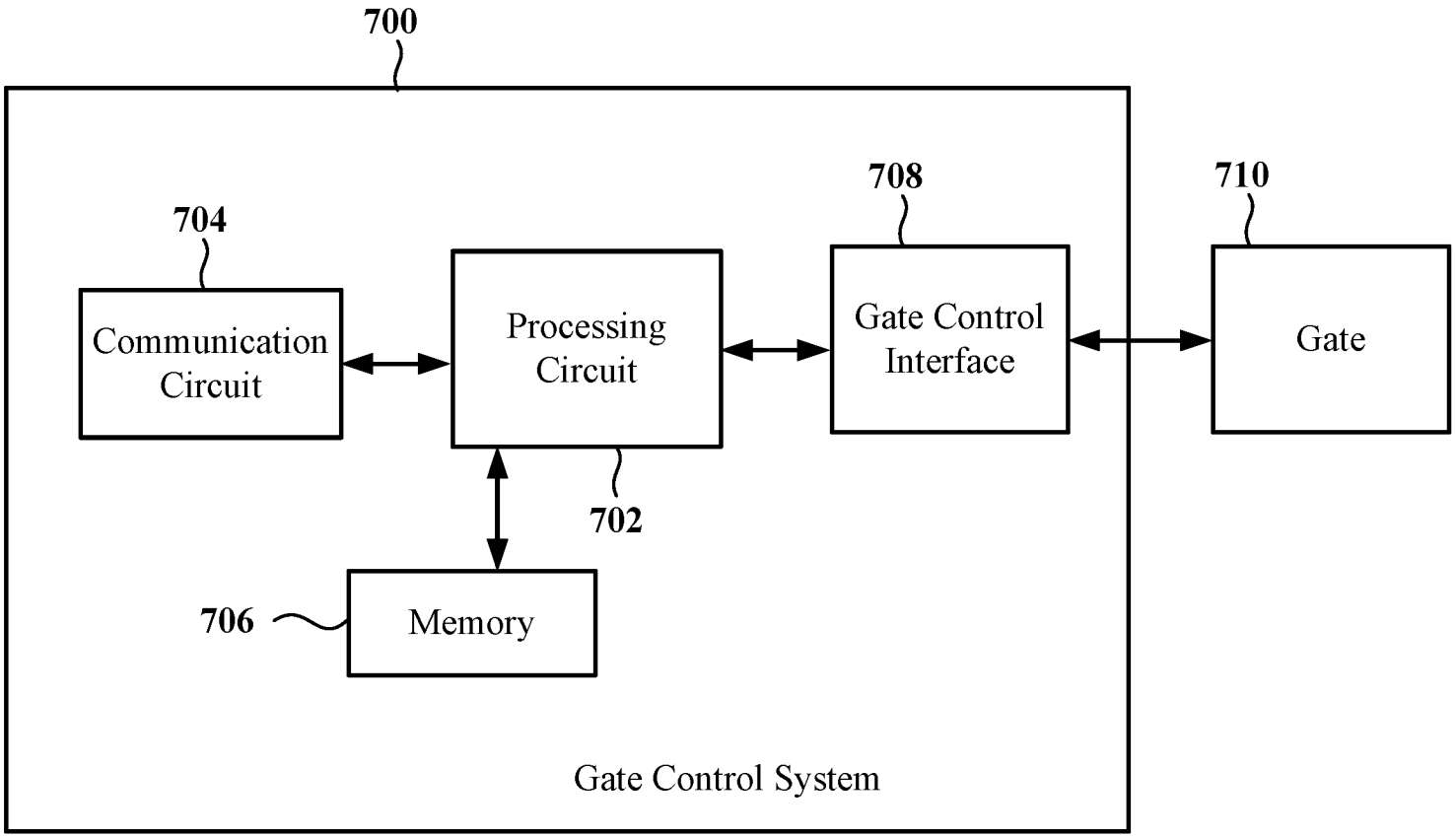
FIG. 13 is a block diagram illustrating an exemplary gate system according to some aspects of the present disclosure.

FIG. 13 is a block diagram illustrating an exemplary gate control system according to some aspects of the disclosure. In some aspects, the gate control system includes a gate controller 700 that can control one or more gates 710. The gates 710 may be used to implement the gates 142, 143, and 600 described above. The gate controller 700 includes a processing circuit 702, a communication circuit 704, a memory device 706, and a gate control interface 708. In some aspects, the gate control interface 708 can physically operate (e.g., open or close) the gate 710 to adjust its position in the trough 103 as described above. In some aspects, the processing circuit 702 can execute code or instructions stored in the memory device 706 to instruct the performance of various functions and procedures used for controlling the gate 710 using the gate control interface 708. In some examples, the gate control interface 708 may include one or more motors and/or actuators for moving the gate 710. The processing circuit 702 can receive control information from the off-board vehicle system 404 using the communication circuit 704. In some aspects, the gate 710 and the gate controller 700 may be included in the same unit. In some aspects, the gate 710 and the gate controller 700 may be separate units that are operationally coupled together. In some aspects, the gate 710 may include motors and/or actuators controlled by the gate control interface for adjusting the position of the gate 710.

Figure 14:
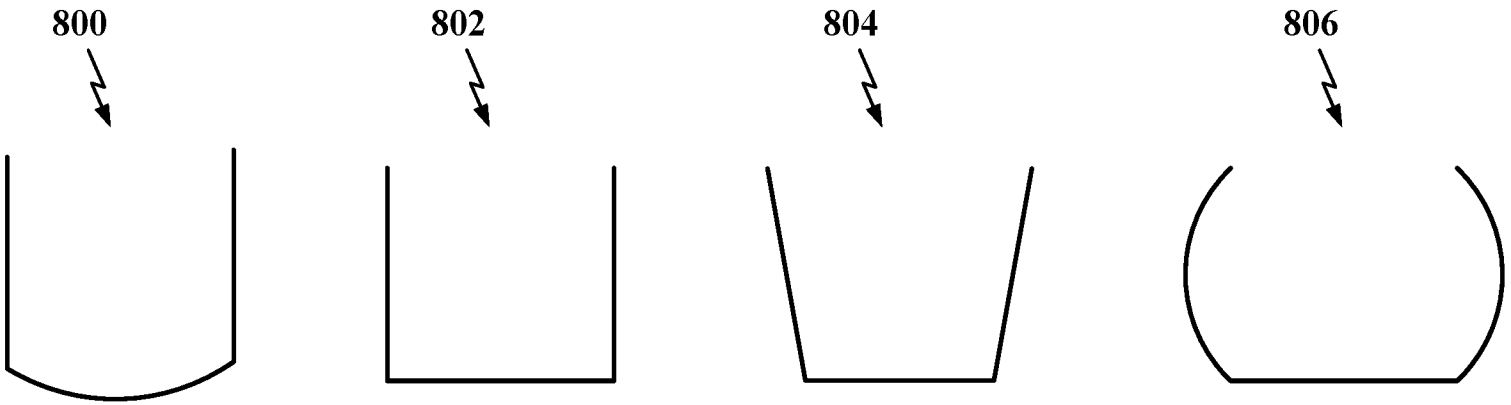
FIG. 14 is a schematic conceptually illustrating various exemplary trough designs according to some aspects of the disclosure.

FIG. 14 is a schematic conceptually illustrating exemplary trough designs that can be used to implement the troughs described above. In a first example, a trough 800 may have flat left and right sides and a rounded bottom side. In a second example, a trough 802 may have a square shape with flat left, right, and bottom sides. In a third example, a trough 804 may have a trapezoid shape with flat left, right, and bottom sides. In a fourth example, a trough 806 may have rounded left and right sides and a flat bottom side.

Figure 15:
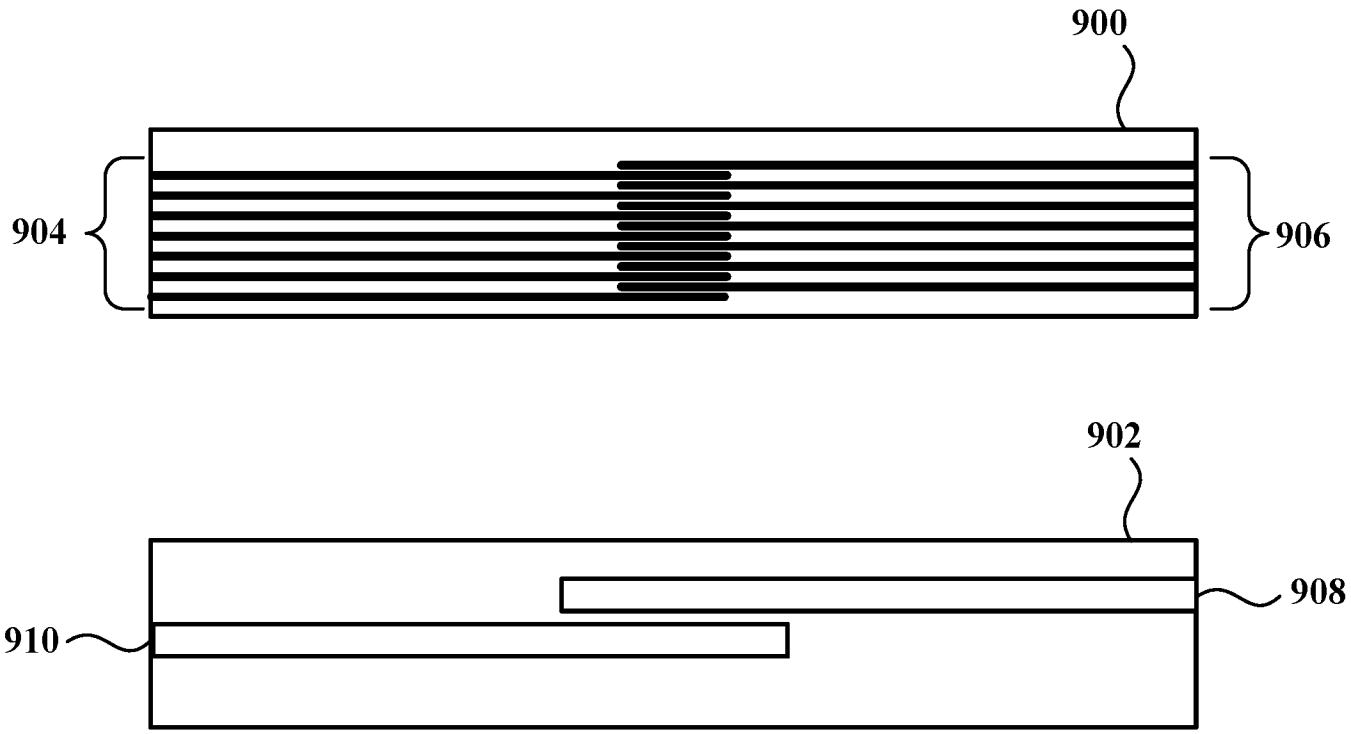
FIG. 15 is a schematic conceptually illustrating two exemplary seal designs according to some aspects of the disclosure.

FIG. 15 is a schematic conceptually illustrating two exemplary seal designs according to some aspects of the disclosure. These seal designs can be used to implement the seal 156 that covers the trough 103 described above in relation to FIGS. 4, 5, 8, 9, and 11. A first seal design 900 and a second seal design 902 are shown with a front view similar to that of the seal 156 shown in the drawings. The first seal design 900 uses bristles (e.g., bristles 904 and 906) projected from opposite sides to form a seal. The bristles 904 and 906 can partially overlap each other to cover the trough 103. The bristles can be made of a flexible and resilient material. The second seal design 902 uses a plurality of flaps (e.g., flaps 908 and 910) projected from opposite sides to form a seal. The flaps 908 and 910 can partially overlap each other to cover the trough 103. In some examples, the flaps can be made of a flexible and resilient material. In some examples, the flaps can be designed to pivot up and down to allow the propulsion element (e.g., propulsion elements 204 and 206) of a vehicle 104 to move through the trough.

Figure 16:
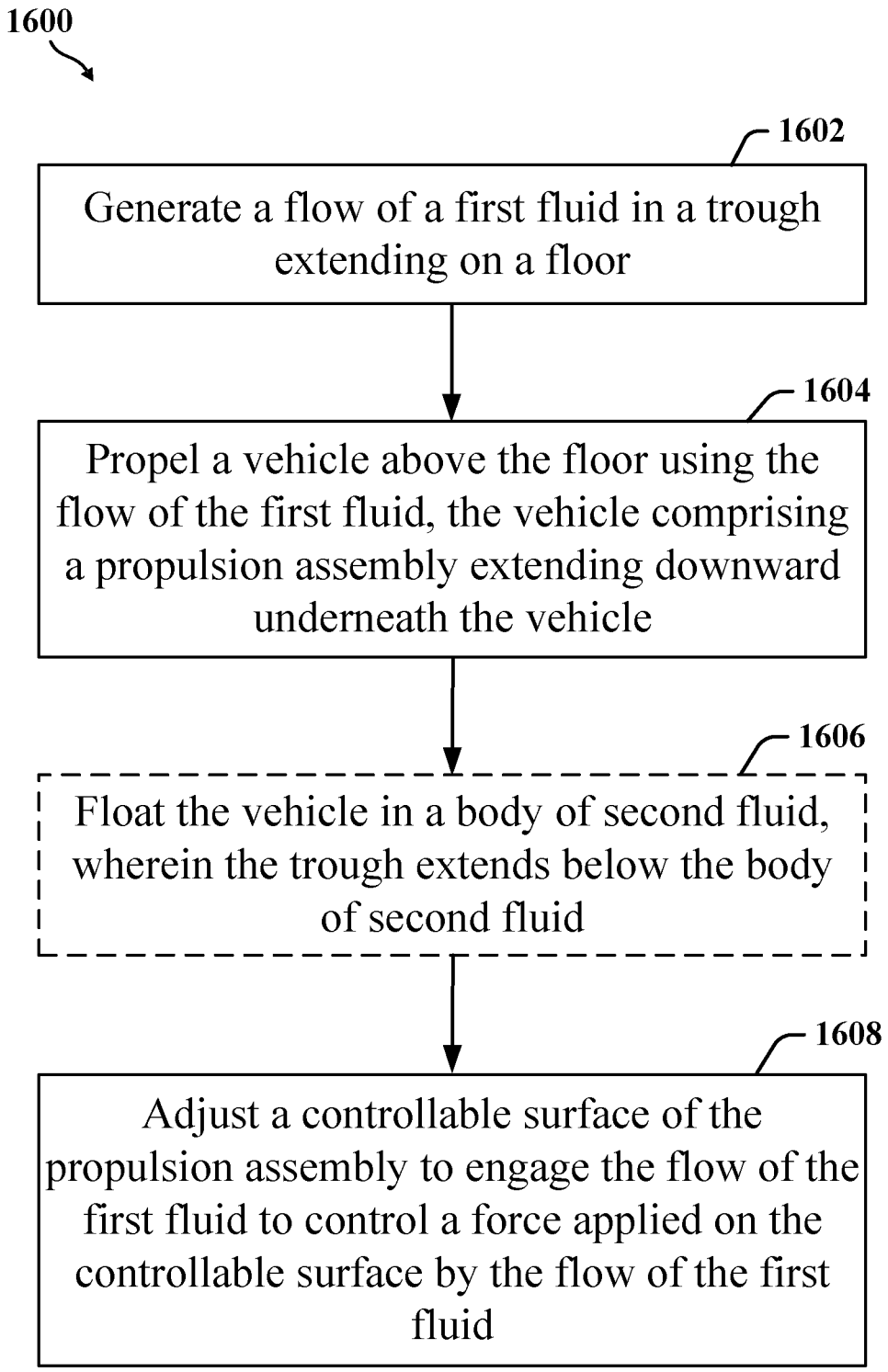
FIGS. 16 and 17 illustrate a flow chart of an exemplary process for operating a vehicle according to some aspects of the present disclosure.
Figure 17:
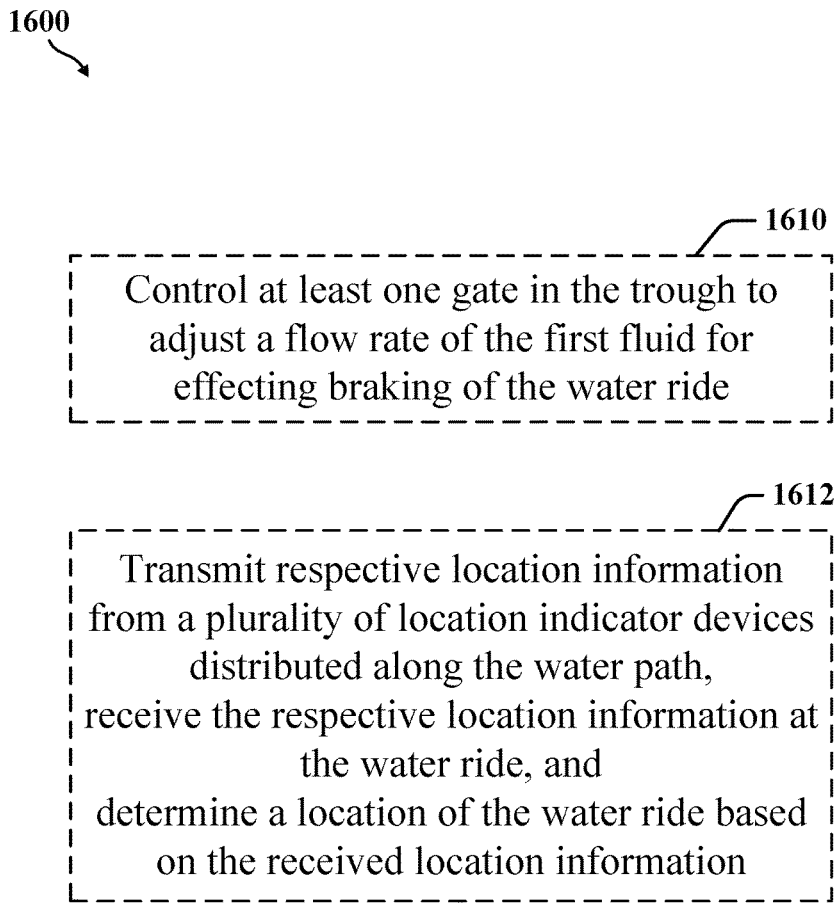

FIGS. 16 and 17 illustrate a flow chart of an exemplary process 1600 for operating a vehicle system according to some aspects of the present disclosure. As described below, some or all illustrated features may be omitted in a particular implementation within the scope of the present disclosure, and some illustrated features may not be required for the implementation of all embodiments. In some examples, the process 1600 may be carried out using the vehicle system 100 illustrated in FIGS. 1-15. In some examples, the process 1600 may be carried out by any suitable apparatus or means for carrying out the functions or algorithm described below.

At 1602, a flow of a first fluid (e.g., water) is generated in a trough extending on or along a floor. In an aspect, a first flow of the first fluid may be generated in a first section of the trough and a second flow of the first fluid may be generated in a second section of the trough that is separated from the first section. The first flow and the second flow of the first fluid may have at least different volumetric flow rates, flow directions, pressures, or speeds. In some aspects, the trough may be the trough 103 described above in relation to FIGS. 1-15. In one example, the fluid pumps 150 or fluid compressors can be a means to generate the flow of fluid in the trough.

At 1604, the flow of the first fluid propels a vehicle (e.g., vehicle 104) above the floor. The vehicle may include a propulsion assembly extending downward underneath the vehicle. In some examples, the flow of fluid may be the flow of fluid 105 that propels the vehicle 104 with the propulsion assembly 202 described above in relation to FIGS. 1-15. In some aspects, the vehicle system can determine the location of the vehicle using a plurality of location indicator devices (e.g., location indicator devices 110, 112, 114, 116, 118, and 120), for example, near the trough.

At 1606, the vehicle may float in a body of second fluid (e.g., water, air), wherein the trough extends below the body of second fluid. The first fluid and the second fluid may be different in density. The first fluid may have a first flow rate, and the second fluid may have a second flow rate that is the same or different than the first flow rate. The first fluid may flow in a first direction, and the second fluid may flow in a second direction that is the same or different than the first direction.

At 1608, a controllable surface of the propulsion assembly can be adjusted to engage the flow of the first fluid to control a force applied on the controllable surface by the flow of the first fluid. In an aspect, the controllable surface is adjusted from a first configuration to a second configuration to change at least one of a speed or a direction of the vehicle. In an aspect, the controllable surface can be adjusted based on a control input received from a passenger of the vehicle to adjust the controllable surface. In an aspect, the controllable surface includes at least one moveable propulsion element configured to be adjusted in a plurality of configurations. Accordingly, an effective surface area of the at least one moveable propulsion element facing the flow of the first fluid may be adjusted by changing a position of the at least one moveable propulsion element. In an aspect, the at least one moveable propulsion element includes a first propulsion element and a second propulsion element that are configured to be moved independently of each other to control respective forces received from the flow of the first fluid. In one example, the at least one moveable propulsion element provides a single controllable surface (e.g., surface area 205 of FIG. 8) for receiving a force applied by the flow of the first fluid. In some examples, the controller 412 and/or propulsion assembly 414 can provide a means to adjust the controllable surface of the propulsion assembly as described above in relation to FIGS. 1-15.

FIG. 17 illustrates additional processes that can be performed in the process 1600 described above in relation to FIG. 16. In some aspects, one or more gates (e.g., controllable gate 142) may be provided in, above, or near the trough. At 1610, at least one gate in the trough may be controlled to adjust a flow rate of the first fluid for effecting braking of the vehicle. In an aspect, the at least one gate may be controlled to change between a first position to provide a first flow rate of the first fluid and a second position to provide a second flow rate of the first fluid. In one example, the gate controller 700 can provide a means to control the at least one gate. The gate controller 70 may control the at least one gate based on the location of the vehicle. At 1612, the plurality of location indicator devices may transmit respective location information. The vehicle may receive the respective location information and determine a location of the vehicle based on the received location information. The vehicle may communicate its location to the vehicle system (e.g., off-board vehicle system 404).

Within the present disclosure, the word "exemplary" is used to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage, or mode of operation. The term "coupled" is used herein to refer to the direct or indirect coupling between two objects. For example, if object A physically touches object B, and object B touches object C, then objects A and C may still be considered coupled to one another-even if they do not directly physically touch each other. For instance, a first object may be coupled to a second object even though the first object is never directly physically in contact with the second object.

One or more of the components, steps, features and/or functions illustrated in FIGS. 1-17 may be rearranged and/or combined into a single component, step, feature, or function or embodied in several components, steps, or functions. Additional elements, components, steps, and/or functions may also be added without departing from novel features disclosed herein. The apparatus, devices, and/or components illustrated in FIGS. 1-17 may be configured to perform one or more of the methods, features, or steps described herein. The novel algorithms described herein may also be efficiently implemented in software and/or embedded in hardware.

It is to be understood that the specific order or hierarchy of steps in the methods disclosed is an illustration of exemplary processes. Based upon design preferences, it is understood that the specific order or hierarchy of steps in the methods may be rearranged. The accompanying method claims present elements of the various steps in a sample order, and are not meant to be limited to the specific order or hierarchy presented unless specifically recited therein.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b, and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f) unless the element is expressly recited using the phrase "means for" or, in the case of a method claim, the element is recited using the phrase "step for."

What is claimed is:

1. A vehicle system comprising:

a trough with a first fluid in the trough; and a vehicle comprising a propulsion assembly, the propulsion assembly comprising a first controllable surface and a second controllable surface that are configured to engage the first fluid, wherein the first controllable surface is adjustable to control a first force applied on the first controllable surface by the first fluid and the second controllable surface is adjustable to control a second force applied on the second controllable surface by the first fluid, wherein the first controllable surface and the second controllable surface are configured to be moved independent of each other.

2. The vehicle system of claim 1, further comprising:

a body of second fluid, wherein the vehicle is configured to float in the second fluid.

3. The vehicle system of claim 2, wherein the first fluid and the second fluid comprise water.

4. The vehicle system of claim 1, wherein the propulsion assembly is configured to adjust the first controllable surface from a first configuration to a second configuration to change at least one of a speed or a direction of the vehicle.

5. The vehicle system of claim 1, wherein the propulsion assembly is configured to provide a passenger of the vehicle with control of the first controllable surface, the second controllable surface, or both.

6. The vehicle system of claim 1, further comprising at least one gate in the trough to control a flow rate of the first fluid.

7. The vehicle system of claim 6, wherein the at least one gate is configured to move between a first position to provide a first flow rate of the first fluid and a second position to provide a second flow rate of the first fluid.

8. The vehicle system of claim 1, further comprising:

a plurality of location indicator devices distributed along the trough; and a sensor onboard the vehicle configured to receive location information from the plurality of location indicator devices.

9. A vehicle for an amusement park ride, the vehicle comprising:

a hull for carrying a passenger in a body of a first fluid; and a propulsion assembly comprising a controllable surface to engage a flow of a second fluid, wherein the propulsion assembly is configured to adjust the controllable surface from a first configuration to a second configuration to change at least one of a speed or a direction of the vehicle in the body of fluid, wherein the controllable surface comprises at least one moveable propulsion element, wherein the at least one moveable propulsion element comprises a first propulsion element and a second propulsion element that are configured to be moved independent of each other to control respective forces received from the flow of the second fluid.

10. The vehicle of claim 9, wherein the propulsion assembly is configured to provide the passenger with control of the controllable surface.

11. The vehicle of claim 9, wherein the at least one moveable propulsion element is configured to be at least one of rotated or translated to control at least the speed or direction of the vehicle.

12. The vehicle of claim 9, wherein the first fluid and the second fluid comprise water.

13. A method of operating an amusement park ride, the method comprising:

generating a flow of a first fluid in a trough extending on a floor;

propelling a vehicle above the floor using the flow of the first fluid, the vehicle comprising a propulsion assembly; and adjusting a controllable surface of the propulsion assembly to engage the flow of first fluid to control a force applied on the controllable surface by the flow of first fluid, wherein the controllable surface comprises at least one moveable propulsion element configured to be adjusted in a plurality of configurations, wherein the at least one moveable propulsion element comprises a first propulsion element and a second propulsion element that are configured to be moved independent of each other to control respective forces received from the flow of the first fluid.

14. The method of claim 13, wherein the adjusting the controllable surface comprises:

adjusting the controllable surface from a first configuration to a second configuration to change at least one of a speed or a direction of the vehicle.

15. The method of claim 14, wherein the adjusting the controllable surface comprises:

receiving a control input from a passenger of the vehicle to adjust the controllable surface.

16. The method of claim 13, wherein the adjusting the controllable surface comprises:

adjusting an effective surface area of the at least one moveable propulsion element facing the flow of the first fluid, by changing a position of the at least one moveable propulsion element.

17. The method of claim 13, further comprising:

controlling at least one gate in the trough to adjust a flow rate of the first fluid.

18. The method of claim 14, further comprising:

transmitting respective location information from a plurality of location indicator devices distributed along the trough;

receiving the respective location information at the vehicle; and determining a location of the vehicle based on the received location information.

* * * * *